US010917709B2

(12) United States Patent
Kunimoto et al.

(10) Patent No.: US 10,917,709 B2
(45) Date of Patent: Feb. 9, 2021

(54) BONE CONDUCTION SPEAKER AND BONE CONDUCTION HEADPHONE DEVICE

(71) Applicant: Panasonic Intellectual Property Management Co., Ltd., Osaka (JP)

(72) Inventors: Hiroshi Kunimoto, Osaka (JP); Suguru Nakao, Hyogo (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 58 days.

(21) Appl. No.: 16/393,132

(22) Filed: Apr. 24, 2019

(65) Prior Publication Data

US 2019/0253781 A1 Aug. 15, 2019

Related U.S. Application Data

(63) Continuation of application No. PCT/JP2017/037307, filed on Oct. 16, 2017.

(30) Foreign Application Priority Data

Oct. 28, 2016 (JP) ..... 2016-211566

(51) Int. Cl.
*H04R 1/10* (2006.01)
*H04R 1/24* (2006.01)
(Continued)

(52) U.S. Cl.
CPC ..... *H04R 1/10* (2013.01); *H04R 1/00* (2013.01); *H04R 1/24* (2013.01); *H04R 7/12* (2013.01);
(Continued)

(58) Field of Classification Search
CPC ... H04R 1/10; H04R 1/00; H04R 1/24; H04R 9/025; H04R 9/063; H04R 7/12;
(Continued)

(56) References Cited

U.S. PATENT DOCUMENTS 3,030,455 A * 4/1962 Pearson ..... H04R 25/606 381/326
4,354,067 A * 10/1982 Yamada ..... A61H 23/0236 381/301
(Continued)

FOREIGN PATENT DOCUMENTS

CN 1759632 4/2006
CN 105745941 7/2016
(Continued)

OTHER PUBLICATIONS

International Search Report dated Dec. 26, 2017 in corresponding International Application No. PCT/JP2017/037307.
(Continued)

*Primary Examiner* — Oyesola C Ojo
(74) *Attorney, Agent, or Firm* — Wenderoth, Lind & Ponack, L.L.P.

(57) ABSTRACT

A bone conduction speaker includes a vibration driver that includes a magnetic circuit and a vibration plate, and that is configured to convert sound into vibration, a vibration body configured to hold a side of the vibration driver, which is adjacent to the magnetic circuit, to come into contact with a subject, and to transmit vibration of the vibration driver to the subject, and a lid body configured to cover a side of the vibration driver, which is adjacent to the vibration plate, without being in contact with the vibration driver, and to substantially seal the vibration driver together with the vibration body.

10 Claims, 5 Drawing Sheets

(51) Int. Cl.
*H04R 9/02* (2006.01)
*H04R 9/06* (2006.01)
*H04R 7/12* (2006.01)
*H04R 1/00* (2006.01)

(52) U.S. Cl.
CPC ..... *H04R 9/025* (2013.01); *H04R 9/063* (2013.01); *H04R 2400/03* (2013.01); *H04R 2460/13* (2013.01)

(58) Field of Classification Search
CPC ..... H04R 2400/03; H04R 2460/13; H04R 2400/11; H04R 1/1075
See application file for complete search history.

(56) References Cited

U.S. PATENT DOCUMENTS

| | | | | |
|---|---|---|---|---|
| 6,198,821 | B1 | 3/2001 | Yang | |
| 6,537,234 | B1 * | 3/2003 | Komatsu | A61H 23/0236 381/396 |
| 8,363,870 | B2 * | 1/2013 | Åsnes | H04R 25/606 381/326 |
| 9,609,412 | B2 * | 3/2017 | Dong | H04R 1/028 |
| 10,397,685 | B2 * | 8/2019 | Ogata | H04R 1/1058 |
| 2003/0112993 | A1 | 6/2003 | Teshima et al. | |
| 2006/0098829 | A1 * | 5/2006 | Kobayashi | H04R 9/066 381/151 |
| 2006/0165246 | A1 | 7/2006 | Lee et al. | |
| 2006/0262954 | A1 * | 11/2006 | Lee | H04M 1/03 381/380 |
| 2013/0163791 | A1 | 6/2013 | Qi et al. | |
| 2014/0185822 | A1 | 7/2014 | Kunimoto et al. | |
| 2015/0030186 | A1 | 1/2015 | Qi et al. | |
| 2015/0146893 | A1 * | 5/2015 | Kunimoto | H04R 5/033 381/151 |
| 2016/0021452 | A1 * | 1/2016 | Tang | H04R 11/00 381/151 |
| 2016/0286320 | A1 * | 9/2016 | Stein (ne Schulze) | H04R 17/005 |
| 2016/0316300 | A1 | 10/2016 | Qi et al. | |
| 2017/0111728 | A1 * | 4/2017 | Kim | H04R 9/06 |
| 2017/0164088 | A1 | 6/2017 | Fukuda | |
| 2017/0374470 | A1 * | 12/2017 | Asfaw | H04R 11/14 |
| 2019/0082266 | A1 | 3/2019 | Qi et al. | |

FOREIGN PATENT DOCUMENTS

| | | |
|---|---|---|
| JP | 59-48189 | 3/1984 |
| JP | 11-113079 | 4/1999 |
| JP | 2000-59878 | 2/2000 |
| JP | 2000-354829 | 12/2000 |
| JP | 2005-536140 | 11/2005 |
| JP | 2009-159402 | 7/2009 |
| JP | 2009-159447 | 7/2009 |
| JP | 2009-206885 | 9/2009 |
| JP | 2012-147315 | 8/2012 |
| JP | 5555811 | 7/2014 |
| JP | 2015-505204 | 2/2015 |
| JP | 2015-126339 | 7/2015 |
| JP | 2016-140005 | 8/2016 |
| WO | 2004/017532 | 2/2004 |
| WO | 2014/103087 | 7/2014 |
| WO | 2015/096434 | 7/2015 |
| WO | 2015/198683 | 12/2015 |

OTHER PUBLICATIONS

English Translation of Chinese Search Report dated Oct. 8, 2019 in related Chinese Patent Application No. 201780065939.8.

* cited by examiner

BONE CONDUCTION SPEAKER AND BONE CONDUCTION HEADPHONE DEVICE

TECHNICAL FIELD

The present disclosure relates to a bone conduction speaker and a bone conduction headphone device each configured to transmit vibration to a subject without interposition of air to allow the subject to recognize sound.

BACKGROUND ART

PTL 1 discloses a bone conduction speaker and a bone conduction headphone device each configured to transmit, to a user, mechanical vibration generated from a vibration driver, and mechanical vibration converted by a vibration plate, to improve quality of high range sound, and to inhibit sound from leaking outside.

CITATION LIST

Patent Literature

PTL 1: Japanese Patent No. 5555811

SUMMARY OF THE INVENTION

The present disclosure provides a bone conduction speaker and a bone conduction headphone device.

A bone conduction speaker according to the present disclosure is a bone conduction speaker configured to transmit vibration to a subject without interposition of air to allow the subject to recognize sound. The bone conduction speaker includes a vibration driver that includes a magnetic circuit and a vibration plate, and that is configured to convert sound into vibration, a vibration body configured to hold a side of the vibration driver, which is adjacent to the magnetic circuit, to come into contact with the subject, and to transmit vibration to the subject, and a lid body configured to cover a side of the vibration driver, which is adjacent to the vibration plate, without being in contact with the vibration driver, and to substantially seal the vibration driver together with the vibration body.

A bone conduction headphone device according to the present disclosure includes a bone conduction speaker, and a holding body configured to cause the bone conduction speaker to come into contact with a head of a user.

The bone conduction speaker and the bone conduction headphone device according to the present disclosure are simple in structure, and are able to improve efficiency of vibration energy.

DESCRIPTION OF EMBODIMENT

Hereinafter, an exemplary embodiment will be described in detail with reference to the drawings as appropriate. However, excessively detailed description may be omitted. For example, a detailed description of a well-known matter and a duplicated description of substantially the same configuration will be omitted in some cases. This is to prevent the following description from being unnecessarily redundant and thus to help those skilled in the art to easily understand the description.

Note that the inventor of the present disclosure provides the accompanying drawings and the following description in order to allow those skilled in the art to fully understand the present disclosure, and does not intend to limit the subject matter as described in the appended claims.

Exemplary Embodiment

[Configuration of Bone Conduction Headphone Device]

Figure 1:
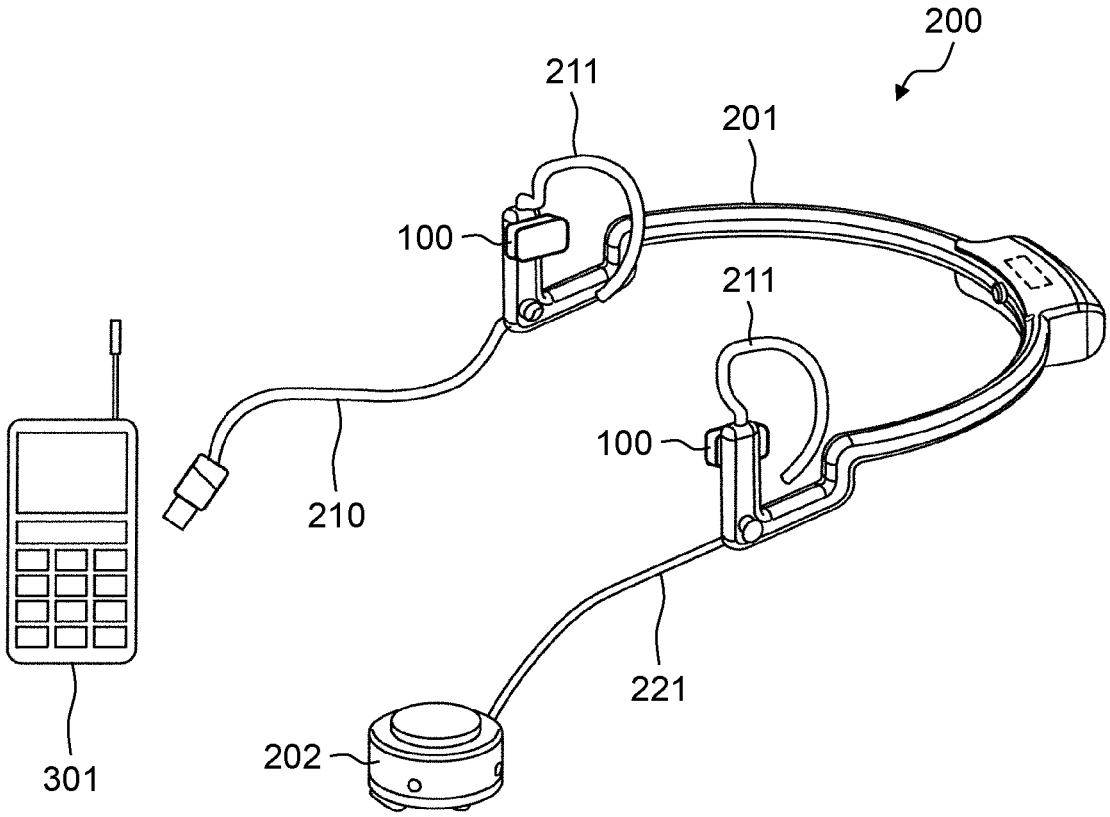
FIG. 1 is a perspective view illustrating an appearance of a bone conduction headphone device according to the present disclosure.

FIG. 1 is a perspective view illustrating an appearance of a bone conduction headphone device according to the present disclosure.

Figure 2:
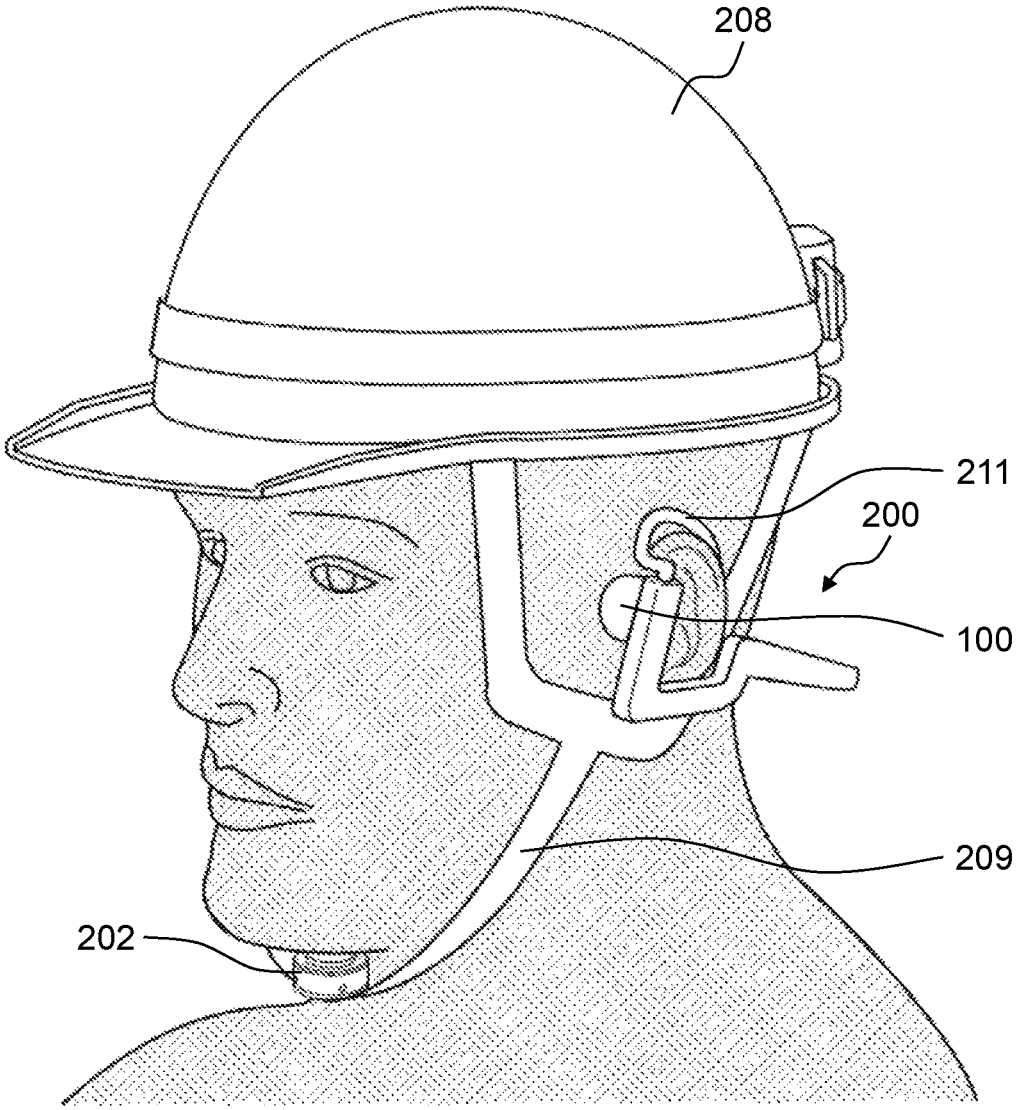
FIG. 2 is a view illustrating an aspect of use of the bone conduction headphone device including a bone conduction microphone.

FIG. 2 is a view illustrating an aspect of use of the bone conduction headphone device including a bone conduction microphone.

As illustrated in the views, bone conduction headphone device 200 includes holding body 201 having a band shape, and bone conduction speakers 100 respectively arranged on both of ends of holding body 201. In the exemplary embodiment, bone conduction headphone device 200 is a headset including bone conduction microphone 202, and is to be coupled to transceiver 301.

[Holding Body 201]

Holding body 201 is to be wrapped around a back of a head or a neck of a user, is made of such a material that has appropriate elasticity including synthetic resin such as polypropylene and metal such as aluminum and stainless steel, and is formed into a substantially U-shape or a substantially C-shape.

Bone conduction microphone 202 is coupled to holding body 201 via microphone cable 221. Holding body 201 includes ear hooks 211. Ear hooks 211 are hooked to ears of the user. Holding body 201 is thus attached to the head. Holding body 201 is coupled to transceiver 301 via headset cable 210.

[Transceiver 301]

Transceiver 301 is attached to a part of a garment, and is configured to perform communications with an external device possessed by a communication partner, for example.

[Bone Conduction Microphone 202]

Bone conduction microphone 202 is attached to chin strap 209 of helmet 208 via metal fixtures, for example.

[Configuration of Bone Conduction Speaker]

Figure 3:
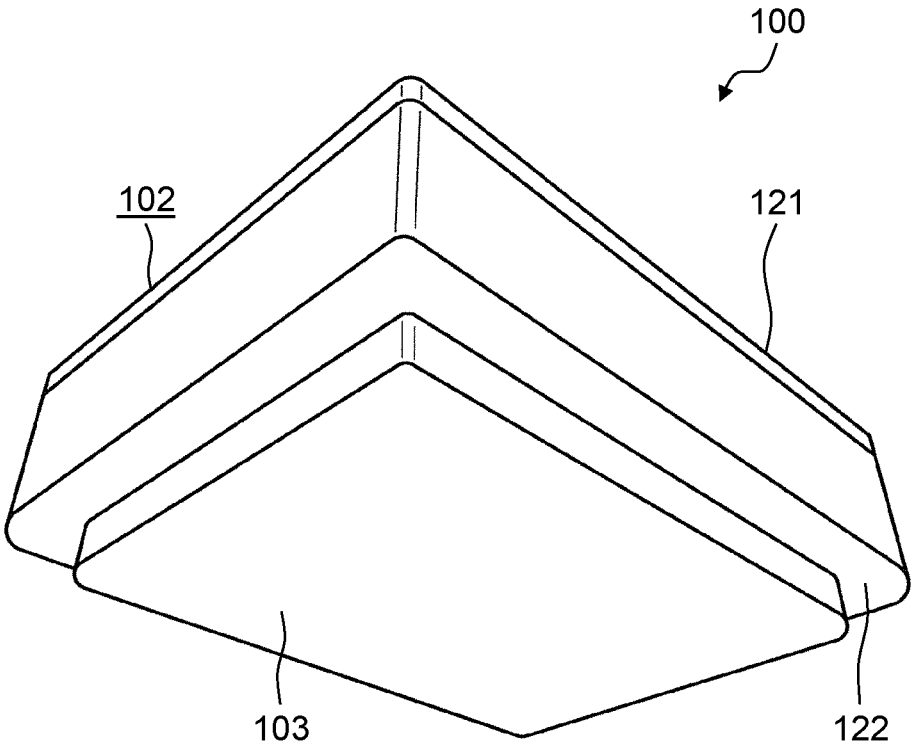
FIG. 3 is a perspective view illustrating an appearance of the bone conduction speaker when viewed from a vibration body.

FIG. 3 is a perspective view illustrating an appearance of the bone conduction speaker when viewed from a vibration body.

Figure 4:
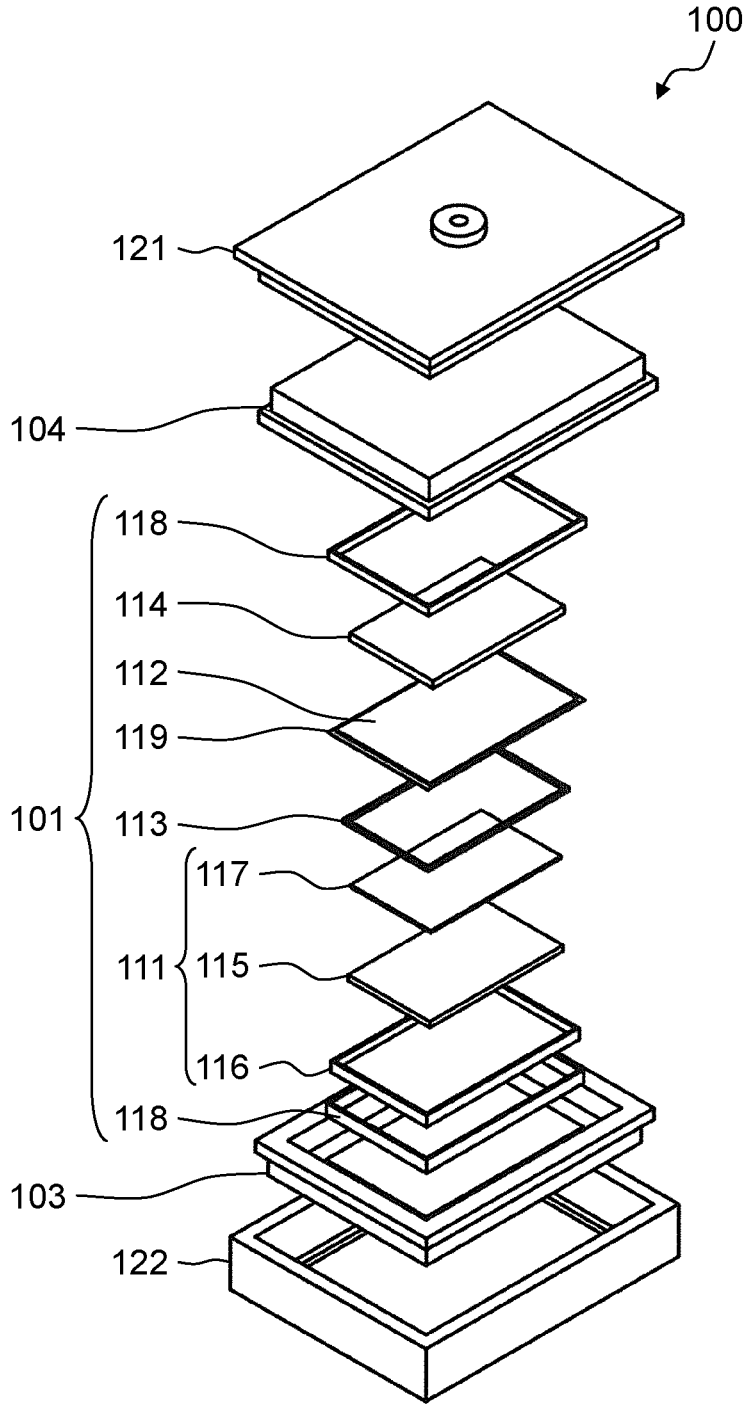
FIG. 4 is a perspective view illustrating the bone conduction speaker when disassembled.

FIG. 4 is a perspective view illustrating the bone conduction speaker when disassembled.

Figure 5:
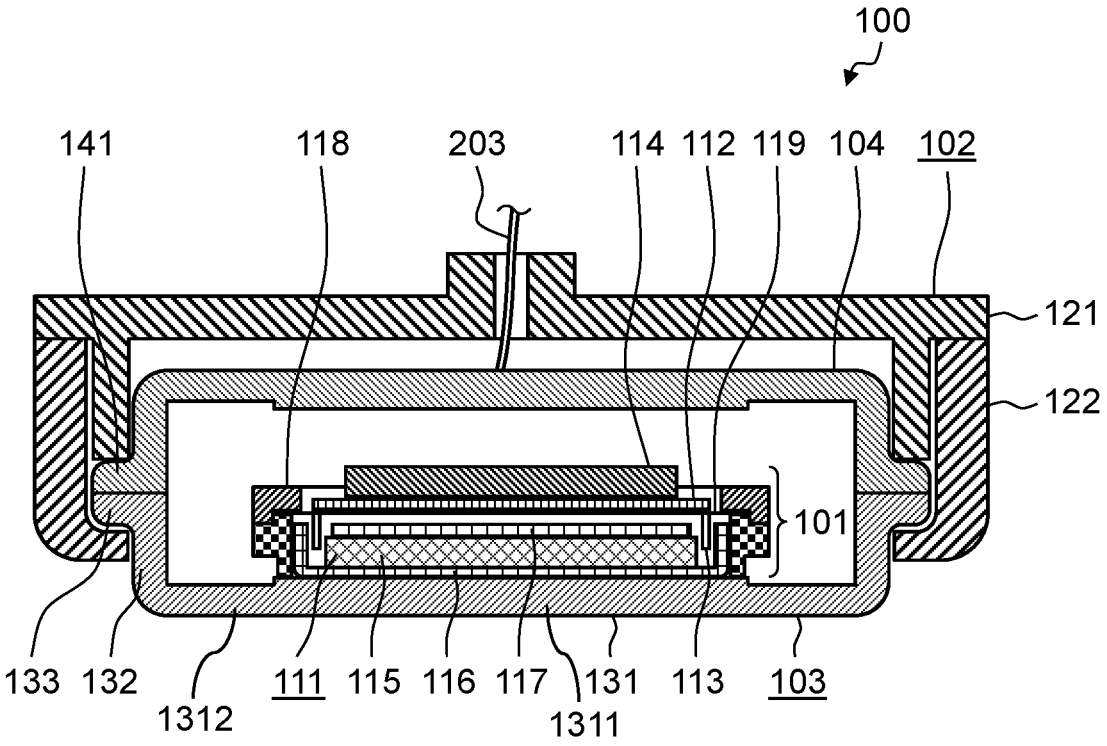
FIG. 5 is a view illustrating a cross section of the bone conduction speaker.

FIG. 5 is a view illustrating a cross section of the bone conduction speaker.

Bone conduction speaker 100 illustrated in the views is a speaker configured to transmit vibration to a subject without interposition of air to allow the subject to recognize sound, and includes vibration driver 101, support body 102, vibration body 103, and lid body 104.

[Vibration Driver 101]

Vibration driver 101 is an electromagnetic type driver configured to convert a sound signal into mechanical vibration, and includes magnetic circuit 111, vibration plate 112, and coil 113. In the exemplary embodiment, vibration plate 112 includes weight 114 attached thereto.

[Coil 113]

Coil 113 is a voice coil configured to generate a magnetic field based on a sound signal. In the exemplary embodiment, vibration driver 101 has a thin cube shape. Therefore, coil 113 is formed from an electric wire wound into a rectangular tubular shape.

[Magnetic Circuit 111]

Magnetic circuit 111 is a circuit configured to form a magnetic gap used to interact with the magnetic field to be generated by coil 113 based on a sound signal. Magnetic circuit 111 includes magnet 115, first yoke 116, and second yoke 117.

[Magnet 115]

Magnet 115 is a permanent magnet configured to supply a stationary magnetic field to the magnetic gap defined when coil 113 is inserted. In the exemplary embodiment, magnet 115 also has a thin cube shape in conformity to the external shape of vibration driver 101.

[Yoke]

First yoke 116 and second yoke 117 are members each configured to bring the magnetic field generated from magnet 115 to the magnetic gap to form a magnetic circuit, and are each made of a magnetic material.

In the exemplary embodiment, first yoke 116 has a rectangular box shape, and includes magnet 115 arranged at a center on a bottom. Second yoke 117 has a rectangular plate shape, and is attached to a surface of magnet 115 to lie opposite to first yoke 116. A rectangular gap is formed between first yoke 116 and second yoke 117. The gap serves as the magnetic gap into which coil 113 is inserted.

[Vibration Plate 112]

Vibration plate 112 is a member attached to an end of magnet 115, and is configured to vibrate relative to magnetic circuit 111 together with magnet 115. Vibration plate 112 is attached to frame 118 via diaphragm 119.

[Diaphragm 119]

Diaphragm 119 is a member having a sheet shape and made of a member softer than vibration plate 112, such as rubber, and corresponds to an edge of an ordinary speaker.

[Frame 118]

Frame 118 is a member having a rectangular annular shape, attached to an outer circumference of first yoke 116 of magnetic circuit 111, and protruding from magnetic circuit 111 toward vibration plate 112. Frame 118 is a member configured to hold vibration plate 112 at a predetermined position via diaphragm 119.

[Weight 114]

Weight 114 is a member attached to vibration plate 112, and is configured to change a resonant frequency of vibration driver 101. In the exemplary embodiment, weight 114 is a member having a plate shape slightly smaller than vibration plate 112 when viewed in plan, thicker than vibration plate 112, and made of a resin such as an acrylic resin.

When a sound signal is entered, vibration driver 101 causes vibration plate 112 and magnetic circuit 111 including magnet 115, for example, to relatively vibrate in phases opposite to each other.

[Vibration Body 103]

Vibration body 103 is a member having a box shape, and is configured to hold a side of the vibration driver, which is adjacent to the magnetic circuit, and to transmit vibration for bone conduction. Vibration body 103 is made of an elastic material such as elastomer, and integrally includes contact part 131, wall part 132, and first flange 133. Specifically, vibration body 103 is an ear pad configured to come into contact with a part of a body of the user, such as the head.

[Contact Part 131]

Contact part 131 has a surface configured to hold a side of vibration driver 101, which is adjacent to magnetic circuit 111, and another surface configured to come into contact with a subject such as the head of the user. Contact part 131 is a part corresponding to a bottom of vibration body 103 having the box shape. While vibration driver 101 being held has a cube shape, contact part 131 has a rectangular plate shape.

Contact part 131 includes holding part 1311 representing a part to which vibration driver 101 is attached, and peripheral part 1312 representing a part that lies on an outer periphery of holding part 1311, and that does not include vibration driver 101 attached thereto. Peripheral part 1312 is the part excluding holding part 1311 on the bottom of vibration body 103, and therefore has a frame shape.

As an example, when a length of a side of contact part 131 in the cross-sectional view in FIG. 5 is 21 mm, a length of a side of holding part 1311 is approximately 15 mm, while a length of each of left and right edges of peripheral part 1312 is approximately 3 mm.

As described above, vibration body 103 is made of an elastic material. Therefore, peripheral part 1312 can function as a spring together with wall part 132, described later, and can efficiently transmit vibration of vibration driver 101 to the subject.

As illustrated in FIG. 5, holding part 1311 is slightly thicker than peripheral part 1312 and wall part 132. With holding part 1311 having a different thickness, as described above, when vibration driver 101 is to be attached, an attaching position can be easily determined. Further, with a change in thickness at a boundary between holding part 1311 and peripheral part 1312, a length of a part caused to function as a spring can be defined.

By changing area, thickness, modulus of elasticity, and hardness of peripheral part 1312, a resonant frequency can be changed. For example, by tuning a resonant frequency to around 400 Hz, bone conduction speaker 100 appropriate for a user listening voice can be achieved. By further softening peripheral part 1312 to set a resonant frequency to around 200 Hz, bone conduction speaker 100 appropriate for a user listening music can also be achieved.

[Wall Part 132]

Wall part 132 is a part rising from contact part 131 without being in contact with the vibration driver. In the exemplary embodiment, contact part 131 is rectangular. Therefore, wall part 132 has a rectangular annular shape. As described above, due to the elasticity of the materials forming wall part 132, peripheral part 1312 successively extending from wall part 132, and vibration body 103, a function like a spring is provided, and thus, efficiently transmitting vibration of vibration driver 101 to the subject.

[First Flange 133]

First flange 133 is a part having a flange shape protruding outward from wall part 132. In the exemplary embodiment, first flange 133 protrudes outward from an end of wall part 132, which is adjacent to vibration plate 112, to have a rectangular annular shape.

Being supported by support body 102 stiffer than vibration body 103, first flange 133 functions as a pivot of vibration when vibration driver 101 vibrates. Even when vibration driver 101 vibrates in accordance with a sound signal, for example, first flange 133 does not substantially vibrate. Therefore, no vibration will be transmitted to support body 102 held by holding body 201, for example. As a result, vibration of vibration driver 101 can be efficiently transmitted to the subject.

[Lid Body 104]

Lid body 104 is a member configured to cover a side of vibration driver 101, which is adjacent to vibration plate 112, without being in contact with vibration plate 112 and weight 114 of vibration driver 101, for example, and to substantially seal the vibration driver together with vibration body 103. In the exemplary embodiment, lid body 104 has a box shape, similar to vibration body 103, and is arranged in a state where an opening part of vibration body 103 and an opening part of lid body 104 abut each other. Therefore, second flange 141 of lid body 104 overlaps with first flange 133 of vibration body 103. Support body 102 pinches first flange 133 and second flange 141 overlapped with each other to generate substantially the sealed state with vibration body 103 and lid body 104. In the exemplary embodiment, lid body 104 is identical to vibration body 103 in material. As described above, with vibration body 103 and lid body 104 identical to each other in shape and material, the number of parts can be reduced, leading to a production cost reduction.

In here, a term "substantially seal" denotes that a hole is provided for allowing electric wire 203 configured to transmit a sound signal to at least one of vibration body 103 and lid body 104 to pass through. When bone conduction speaker 100 is used, electric wire 203 passing through the hole air-seals the inside of vibration body 103 and lid body 104.

Lid body 104 is configured to receive vibration of air caused as vibration plate 112 vibrates. Lid body 104 itself then vibrates. Lid body 104 has a function of transmitting the vibration to vibration body 103 via the flange, of allowing energy of the vibration of vibration driver 101 to concentrate to vibration body 103, and of efficiently transmitting the vibration to the subject.

Similar to vibration body 103, second flange 141 of lid body 104 serves as a pivot of vibration. Therefore, vibration of lid body 104 will not be transmitted to support body 102, but can be effectively transmitted to vibration body 103.

[Support Body 102]

Support body 102 is a structure member configured to support vibration driver 101 via vibration body 103. Support body 102 supports first flange 133 of vibration body 103, allowing vibration driver 101 to substantially freely vibrate. Support body 102 is a part configured to use holding body 201, for example, of the bone conduction headphone device to hold bone conduction speaker 100.

In the exemplary embodiment, support body 102 has a rectangular tubular shape, is arranged to surround vibration driver 101, and includes first support body 121 and second support body 122 fitted with each other in a spigot manner. A gap shorter than a thickness of both first flange 133 and second flange 141 is provided between first support body 121 and second support body 122. When first support body 121 and second support body 122 are fitted with each other, and first flange 133 and second flange 141 overlapped with each other are fitted into the gap, support body 102 pinches a whole circumference of first flange 133 and second flange 141 in a thickness direction. Therefore, an internal space of vibration body 103 and lid body 104 is substantially sealed, allowing vibration of lid body 104 to easily transmit to vibration body 103.

First support body 121 has a bottomed tubular shape. The hole used to arrange electric wire 203 is provided at a center of a bottom.

[Operation and Effects]

Figure 6:
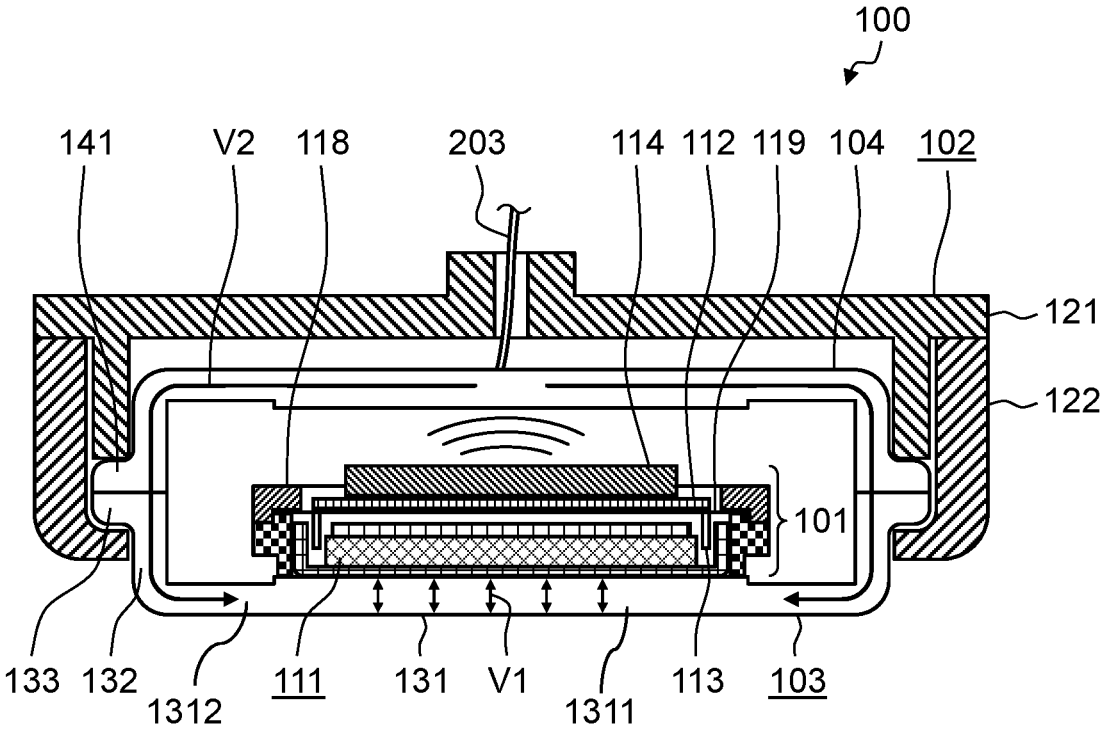
FIG. 6 is an operation description view of a vibration driver.

FIG. 6 is an operation description view of the vibration driver.

When a sound signal is transmitted to coil 113, magnetic circuit 111 and vibration plate 112 including weight 114 respectively relatively vibrate (in directions opposite to each other). The vibration of magnetic circuit 111 is directly transmitted to vibration body 103 to allow contact part 131 to vibrate due to elasticity of peripheral part 1312 (vibration V1). The vibration of vibration plate 112 allows internal air in vibration body 103 and lid body 104 to vibrate. Lid body 104 converts the vibration of the internal air into mechanical vibration, and transmits the mechanical vibration to vibration body 103 (vibration V2).

Vibration body 103 and lid body 104 vibrate about first flange 133 and second flange 141 serving as a pivot. Therefore, even when vibration driver 101 vibrates, support body 102 does not substantially vibrate.

With the operation described above, most of energy generated when vibration driver 101 vibrates can be concentrated into mechanical vibration of contact part 131 of vibration body 103. Therefore, the user can efficiently recognize sound through bone conduction.

As air vibration generated from vibration plate 112 is converted into mechanical vibration via lid body 104, other parts than contact part 131 would be less likely to vibrate. Further, lid body 104 being surrounded by support body 102, particularly by first support body 121 via a space, can suppress sound from leaking.

Further, in the exemplary embodiment, the ear pads configured to come into contact with the parts of the body of the user, such as the head, are used as vibration bodies 103 respectively configured to hold vibration drivers 101, achieving a simple structure, compared with ordinary bone conduction speakers. Therefore, a production process can be simplified, achieving a smaller device with a reduced cost.

In the exemplary embodiment, a space is provided between vibration driver 101 and wall part 132 of vibration body 103 to form peripheral part 1312. Peripheral part 1312 is made of an elastic material, and thus has a spring feature. With the configuration described above, vibration of vibration driver 101 can be amplified by the spring, and transmitted to the user.

The present disclosure should not be limited to the exemplary embodiment described above. For example, the components described in the specification may be combined as desired. The present disclosure may include, as one of exemplary embodiments, another exemplary embodiment achieved by eliminating some of the components. The scope of the present disclosure should include any modifications obtainable through various changes to the above exemplary embodiment that can be conceived by those skilled in the art without deviating from the spirit of the present disclosure, that is, the meaning of the wording as defined by the appended claims.

The exemplary embodiment has described that bone conduction speaker 100 has a thin cube shape. However, a whole shape of bone conduction speaker 100 and shapes of the other members are not particularly limited. For example, vibration driver 101, coil 113, magnetic circuit 111, and vibration plate 112 may each have a columnar (cylindrical)

shape, for example. In this case, vibration body 103, lid body 104, and support body 102 may each have a cylindrical shape.

Vibration body 103 and lid body 104 are identical to each other in material and shape. However, the present disclosure is not limited to the configuration. For example, lid body 104 may be harder or softer in hardness than vibration body 103. Vibration body 103 and lid body 104 may differ from each other in shape.

Vibration plate 112 is not particularly limited in material, but may be made of resin, metal, or paper, for example. Vibration plate 112 and weight 114 have been described as separate components. However, vibration plate 112 and weight 114 may be integrated with each other.

Contact part 131 (holding part 1311 and peripheral part 1312), wall part 132, and first flange 133 of vibration body 103 are integrally formed. However, the present disclosure is not limited to the configuration. The components may once be formed separately, and then may be assembled with each other. In this case, at least peripheral part 1312 needs to be made of an elastic material to have a spring feature.

In bone conduction headphone device 200, bone conduction speakers 100 are respectively provided on both of the ends of holding body 201. However, bone conduction speaker 100 may be provided on one of the ends of holding body 201. In this case, a pad may be provided, instead of bone conduction speaker 100, on the other of the ends of holding body 201, for example. Holding body 201 may have a shape configured to wrap around a head of a user. Holding body 201 may not be used to form an ear hanging type headphone device, for example.

INDUSTRIAL APPLICABILITY

The present disclosure is applicable to bone conduction speakers and bone conduction headphone devices. Specifically, the present disclosure is applicable to cellular phones and smartphones, for example, and portable music players, for example.

REFERENCE MARKS IN THE DRAWINGS

100: bone conduction speaker
101: vibration driver
102: support body
103: vibration body (ear pad)
104: lid body
111: magnetic circuit
112: vibration plate
113: coil
114: weight
115: magnet
116: first yoke
117: second yoke
118: frame
119: diaphragm
121: first support body
122: second support body
131: contact part
1311: holding part
1312: peripheral part
132: wall part
133: first flange
141: second flange
200: bone conduction headphone device
201: holding body
202: bone conduction microphone
203: electric wire
208: helmet
209: chin strap
210: headset cable
221: microphone cable
301: transceiver

The invention claimed is:

1. A bone conduction speaker configured to transmit vibration to a subject without interposition of air to allow the subject to recognize sound, the bone conduction speaker comprising:

a vibration driver including a magnetic circuit and a vibration plate, the vibration driver being configured to convert sound into vibration;

a vibration body configured to hold a side of the vibration driver, the side being adjacent to the magnetic circuit, to come into contact with the subject, and to transmit vibration of the vibration driver to the subject; and a lid body configured to cover a side of the vibration driver, the side being adjacent to the vibration plate, without being in contact with the vibration driver, and to substantially seal the vibration driver together with the vibration body, wherein the vibration body includes a holding part having a plate shape having a surface configured to hold the vibration driver, and another surface configured to come into contact with the subject, a peripheral part made of an elastic material, the peripheral part lying on an outer periphery of the holding part, the peripheral part being configured to come into contact with the subject together with the holding part, and a wall part rising from the peripheral part.

2. The bone conduction speaker according to claim 1, wherein the vibration body is an ear pad configured to come into contact with the subject that is a part of a body of a user.

3. The bone conduction speaker according to claim 1, wherein the vibration body and the lid body are identical to each other in shape.

4. A bone conduction speaker configured to transmit vibration to a subject without interposition of air to allow the subject to recognize sound, the bone conduction speaker comprising:

a vibration driver including a magnetic circuit and a vibration plate, the vibration driver being configured to convert sound into vibration;

a vibration body configured to hold a side of the vibration driver, the side being adjacent to the magnetic circuit, to come into contact with the subject, and to transmit vibration of the vibration driver to the subject; and a lid body configured to cover a side of the vibration driver, the side being adjacent to the vibration plate, without being in contact with the vibration driver, and to substantially seal the vibration driver together with the vibration body, wherein the bone conduction speaker includes a support body configured to support the vibration driver via the vibration body, the vibration body includes a first flange protruding outward, the lid body includes a second flange protruding outward, the second flange being configured to overlap with the first flange, and the support body is configured to pinch the first flange and the second flange overlapped with each other.

5. The bone conduction speaker according to claim 1, wherein the vibration driver includes a weight attached to the vibration plate, the weight being configured to change a resonant frequency.

6. A bone conduction headphone device comprising:

the bone conduction speaker according to claim 1; and a holding body configured to cause the bone conduction speaker to come into contact with a head of the user.

7. The bone conduction speaker according to claim 4, wherein the vibration body is an ear pad configured to come into contact with the subject that is a part of a body of a user.

8. The bone conduction speaker according to claim 4, wherein the vibration body and the lid body are identical to each other in shape.

9. The bone conduction speaker according to claim 4, wherein the vibration driver includes a weight attached to the vibration plate, the weight being configured to change a resonant frequency.

10. A bone conduction headphone device comprising:

the bone conduction speaker according to claim 4; and a holding body configured to cause the bone conduction speaker to come into contact with a head of the user.

* * * * *